United States Patent [19]

Bishop

[11] Patent Number: 4,778,611

[45] Date of Patent: Oct. 18, 1988

[54] OIL ADDITIVE PROCESS

[76] Inventor: Herbert Bishop, 152 E. 100 South, Box 521, Raymond, Alberta, Canada, T0K 2S0

[21] Appl. No.: 858,916

[22] Filed: May 2, 1986

[30] Foreign Application Priority Data

May 2, 1985 [CA] Canada ..... 480566

[51] Int. Cl.[4] ..... C10M 139/00

[52] U.S. Cl. ..... 252/37.2; 252/37.7

[58] Field of Search ..... 252/35, 37, 37.2, 37.7

[56] References Cited

U.S. PATENT DOCUMENTS 2,231,169 2/1941 Lazar ..... 252/37

2,456,824 12/1948 Fischer ..... 252/37

4,555,352 11/1985 Garner et al. ..... 252/35

*Primary Examiner*—Jacqueline V. Howard

*Attorney, Agent, or Firm*—Pascal & Associates

[57] ABSTRACT

A method for making an oil additive comprising adding 2 gallons of 3% sodium hypochlorite to 45 gallons of diesel oil fuel, or similar proportions, to form a sulphur free fuel, removing all water and foreign matter formed by the sodium hypochlorite, blending 30 gallons of 24% lead naphthanate with 15 gallons of said sulphur free fuel, 15 gallons of light-weight mineral oil and about ½ gallon of 0.75% nitro benzene, or similar proportions to form a blended mixture, and heating the blended mixture slowly and uniformly to 152° F.

9 Claims, No Drawings

OIL ADDITIVE PROCESS

This invention relates to engine lubrication, and in particular to an additive for lubrication oil.

While petroleum oils have been used to lubricate automotive engines since the early days of the automobile, engine wear and friction has remained a problem. The film of oil surrounding the moving parts of the engine sometimes breaks down, causing metal to metal contact and excessive wear. Furthermore, reduced friction can decrease the amount of power lost within the engine, and thus can increase mileage, or reduce fuel consumption for a predetermined amount of power output.

Reduction in friction can be obtained by adding an additive to the lubricating oil. Such additives are commercially sold and are claimed to increase the film strength of the oil, reduce friction, etc.

The present invention is a process for manufacturing an oil additive which has been shown to reduce engine wear by one half under some conditions, and to reduce the coefficient of friction by between 5–15% under some conditions. Such a saving clearly is significant.

The additive can be made by combining a light oil with metallic naphthanate (such as lead naphthanate, zirconium naphthanate, calcium naphthanate and zinc naphthanate) and blending with it a very light carbon based fuel such as diesel fuel which has been treated with bleach, such as sodium hypochlorite. The blended mixture is then heated slowly and uniformly to an effective temperature as will be described below. An "effective temperature" should be construed as the temperature which causes the molecules to bond.

It is important to realize that an important aspect of the invention is the use of bleach, e.g. sodium hypochlorite, whereby the chlorine in the bleach, being more active than oxygen, substantially stops the possibility of oxidation.

In a preferred embodiment, a method for making the oil additive is comprised of the steps of adding two gallons of 3% sodium hypochlorite to 45 gallons of diesel fuel. The resulting fuel will be sulphur free. Care must be taken to make sure that all water and other foreign matter produced by the sodium hypochloride is not allowed to enter the finished product. A 60° cone will allow this matter to settle out.

30 gallons of 24% lead naphthanate, 15 gallons of the sulphur free fuel obtained above, and 15 gallons of light-weight mineral oil are thoroughly blended—with about ½ gallon of 0.75% nitrobenzene using a pump unit. Of course the absolute quantities of the ingredients noted above need not be used; similar proportions can be used in other quantities.

The blended mixture is slowly and uniformly heated to 152° F. The mixture should be blended occasionally so that it heats uniformly.

The product formed using the above process has been found to be a highly useful oil additive suitable for most industrial applications. However for use as a consumer item, the nitrobenzene should be deleted. After heating approximately 2% W/W of cyclosol 63 is added as an aromatic, to give the product a distinctive odor.

For use in large engines, it is desirable to use silver as a liner for bearing surfaces. To obtain the desired product, the light-weight mineral oil which is used must be of a kind which does not contain zinc. Instead, an oil containing no zinc such as Galena RDS 40 should be used, which is available from Imperial Oil. Otherwise in the first-described process the light-weight mineral oil used can be 10W such as Shell Tellus No. 32.

It has been found that the sodium hypochlorite will also hide or disguise the amount of lead in the final product, which would ordinarily show at 12%. Under most tests only 0.25% or 2,500 PPM has been found to show.

A person understanding this invention may now conceive of other embodiments or variations. All are considered to be within the sphere and scope of the invention as defined in the claims appended hereto.

I claim:

1. A method of making an oil additive comprising:

(a) adding 2 parts by volume of 3% sodium hypochlorite to 45 parts by volume of diesel oil fuel to form a sulphur free fuel, (b) removing all water and foreign matter formed by the sodium hypochlorite, (c) blending 30 parts by volume of 24% lead naphthanate with 15 parts by volume of said sulphur free fuel, 15 parts by volume of light-weight mineral oil to form a blended mixture, and (d) heating the blended mixture slowly and uniformly to 152° F.

2. A method as defined in claim 1 including the additional step of adding approximately 2% W/W of Cyclosol 63 TM as an aromatic.

3. A method as defined in claim 1 including blending about ½ part by volume of 0.075% nitrobenzene with the mineral oil, lead naphthanate and sulphur free fuel prior to heating.

4. A method as defined in claim 1 in which the oil is zinc free.

5. A method of making an oil additive comprising adding 2 parts by volume of 3% sodium hypochlorite to 45 parts by volume of a light carbon based fuel and blending it with a metallic naphthanate and a light weight mineral oil containing substantially no zinc, and heating the blended mixture uniformly to 152° F.

6. A method as defined in claim 5 in which the naphthanate is lead naphthanate.

7. A method as defined in claim 5 in which the naphthanate is calcium naphthanate.

8. A method as defined in claim 5 in which the naphthanate is zirconium naphthanate.

9. A method as defined in claim 5 in which the naphthanate is zinc naphthanate.

* * * * *